United States Patent [19]

Pertramer

[11] Patent Number: 4,630,563

[45] Date of Patent: Dec. 23, 1986

[54] TRAPEZE BELT OR HARNESS FOR WINDSURFING

[76] Inventor: Siegried Pertramer, Ferdinand-Miller-Strasse 11, D-8080 Fürstenfeldbruck, Fed. Rep. of Germany

[21] Appl. No.: 673,808

[22] Filed: Nov. 21, 1984

[30] Foreign Application Priority Data

Nov. 24, 1983 [DE] Fed. Rep. of Germany ..... 3342526
Sep. 17, 1984 [DE] Fed. Rep. of Germany ..... 3434087

[51] Int. Cl.[4] ..... B63H 9/04
[52] U.S. Cl. ..... 114/39
[58] Field of Search ..... 114/39.1, 39.2, 97–99, 114/218, 253; 440/33, 34; 182/3

[56] References Cited

U.S. PATENT DOCUMENTS

| | | | |
|---|---|---|---|
| 2,725,853 | 12/1955 | Nordheim | 182/3 |
| 3,004,519 | 10/1961 | Weissman | 182/3 |
| 4,112,865 | 9/1978 | Carn | 114/39.2 |
| 4,235,182 | 11/1980 | Burger | 114/39 |
| 4,418,631 | 12/1983 | Frohbach | 114/39 |
| 4,452,161 | 6/1984 | McCoy | 114/39 |

FOREIGN PATENT DOCUMENTS

| | | | |
|---|---|---|---|
| 66177 | 12/1982 | European Pat. Off. | 114/39.2 |

*Primary Examiner*—Galen Barefoot
*Assistant Examiner*—Stephen P. Avila
*Attorney, Agent, or Firm*—Armstrong, Nikaido, Marmelstein & Kubovcik

[57] ABSTRACT

The invention relates to a trapeze belt or harness (1) for windsurfing or board sailing. A hook (14) is disposed on a carriage member (13) which is laterally displaceable on guide tracks (11, 12) with respect to a holding member constructed as wide spreader bar (7). The guide tracks (11, 12) can form at the same time the spreader bar. The carriage member (13) is held by a return mechanism (17) in its center position. Preferably, the guide tracks (11, 12) are arcuately formed forwardly and upwardly. By this construction the hook (14) is always in the optimum position irrespective of the posture of a user 24, the forces taken up by the trapeze (1) being transmitted in large-area manner to the body without constriction of the chest.

17 Claims, 10 Drawing Figures

TRAPEZE BELT OR HARNESS FOR WINDSURFING

The invention relates to a trapeze belt or harness for windsurfing or board sailing comprising a hook which is secured to shoulder belts and a chest belt via a holding means and which is adapted to be suspended in lines or the like secured on both sides to the wishbone boom of a windsurfer with both ends, the belts being connected to a cushioned large-area back portion, the hook lying on the chest of the user when the trapeze belt is fitted, the holding means being constructed as spreader bar of stiff material in a length corresponding substantially to the chest width of a user and the ends of the chest belt engaging the ends of the spreader bar.

Trapeze belts of this fundamental type have been generally known since about 1976 under the name "Hawaii trapeze" (cf for example the windsurfing magazine SURF, July 1980, page 46 et seq.).

Known trapeze belts consist usually of a possibly cushioned back portion made from canvas or the like and having two suspenders-like shoulder belts which together with a chest belt are brought together to a holding means to which is secured the hook for suspension on the wishbone boom or the lines secured thereto. For safety reasons in known trapeze belts possibly at least the chest belt comprises a quick-release clasp so that the user can get free of the trapeze in the event of a fall. When the trapeze belt is put on by the user the hook lies substantially at the lower end of the breastbone. It is also known to equip such trapeze belts at the back portion with a small rucksack for accomodating spares, money, automobile keys or the like.

The known trapeze belts of this fundamental type have the disadvantage that in particular under strong wind and for longer trips because the entire force has to be taken up practically by the chest belt which is connected to the flexible back portion a pronounced constriction of the thorax occurs because a considerable pressure is exerted from both sides on the ribs and this makes trapeze surfing unpleasant after any length of time. When gusts occur this phenomenon becomes more pronounced and is further intensified by the fact that with respect to the user the force applied to the hook is directed inclined upwardly.

In a design of a trapeze belt of the type explained in detail at the beginning the thorax is relieved by the holding device being constructed as spreader bar of stiff material, the ends of the chest belt engaging the ends of the spreader bar. Such a trapeze design is described in DE-OS 3,140,668, a large-area plastic member being provided as spreader bar, in the centre of which by means of a base plate consisting of metal the hook is rigidly secured. The spreader bar counteracts the lateral compression of the chest in that the force applied at the hook is introduced practically parallel to the chest sides and transmitted to the back portion.

Although this design achieves a considerable advantage with regard to the distribution of the forces acting on the thorax of a user it has been found in windsurfing in practice that this known design has the disadvantage that the force is transmitted asymmetrically to the body. For in all known trapeze belts the hook is attached substantially in the middle of the user's chest. However, it is only very seldom that a surfer stands with the front of his chest directly facing the sail because he always tries to adopt a slightly forwardly turned posture. In this case with the known design the wide spreader bar is positively obstructive because the end relieved in this posture tends to project away from the body whilst the loaded end shifts the entire trapeze belt with respect to the body.

The problem underlying the invention is to provide a trapeze belt of the type defined at the beginning in which irrespective of the position assumed by the user the hook is always in an optimum location and in particular the forces transmitted to the body are introduced symmetrically into the trapeze belt.

This problem is solved essentially in that the hook is secured to a carriage member which is guided tied with respect to the spreader bar and is transversely displaceable. It is obvious that this proposal according to the invention makes it possible for the user to turn with respect to the sail without the ends of the spreader bar being differently loaded.

In a preferred further development of the invention a return means is provided which insures the center position of the carriage member with respect to the length of the spreader bar. This further development of the invention is of advantage because after manoeuvres or intermediate releasing of the hook the latter is always in the usual center position of the spreader bar.

It is in particular advantageous to make the spreader bar out of an upper and a lower guide track for the carriage movement.

In a particular preferred embodiment the guide tracks are arcuately curved upwardly, the highest point of the arc corresponding to the center position of the carriage member. This particular construction of the guide tracks prevents unhooking, i.e. a detaching of the hook from the trapeze line. In addition, as a result the plane of the hook is straight in any position and it is insured that in any position of the user a constant tension is exerted downwardly on the trapeze line.

It is more especially particularly advantageous to arch the guide tracks likewise arcuately forwardly, the highest point of the arc likewise corresponding to the center position of the carriage member. This provides between the body of the user and the carriage member a necessary play for the unrestricted hook movement or the unrestricted movement of the carriage.

It is most expedient to form the guide tracks by tube sections which at the same time form the spreader bar.

It is in particular especially preferred for the securing points for the chest belt portions to be formed as perpendicularly extending slit-like openings beyond the two opposing ends of the guide tracks, and it is particularly preferred for the slit-shaped openings to be upwardly offset with respect to the ends of the guide tracks. A particularly preferred further development of this embodiment resides in that the upper ends of the slit-like openings lie substantially at the level of the uppermost point of the upper guide track. This construction prevents in simple manner the spreader bar from executing tilting movements in particular forwardly when relieved.

In alternative embodiments it is also possible to construct the guide tracks with different curvatures forwardly to obtain particularly suitable orientations of the hook for the various surfing positions.

In a proven practical embodiment the carriage member slidingly accomodates the lower guide track in a through bore and the upper guide track is accommodated in a recess open on one side and extending parallel to the bore. This makes it possible in the construction described, in which the guide tracks form simultaneously the spreader bar, to secure easily to the upper guide track one or more securing eyes for the shoulder belt portions which then lie in the path of movement of the recess of the carriage member, i.e. do not obstruct the movement thereof.

In a practical example of embodiment it is preferred to make the return means as rubber band or the like holding the carriage member in the center position.

In a particularly preferred embodiment of the invention in addition a locking means is provided for locking the carriage member in the center position. This gives the user of the trapeze belt according to the invention the additional possibility of being able to use the belt like a conventional trapeze belt which can be particularly advantageous for beginners. In particular this embodiment can be further developed in that the locking means is formed by a slide which engages in positive manner between two stops.

In advantageous manner the stops are formed by portions of the securing eyes standing substantially perpendicularly with respect to the guide track, the spacing of the securing eyes corresponding to the width of the slide.

It is in particular preferred for the slide to be mounted on a recess of the carriage member in sliding displaceable manner. This makes it possible in simple manner to lock the carriage member by actuating the slide.

A particularly preferred embodiment according to the invention is characterized in that at the lower guide track two stops corresponding to the stops at the upper guide track are provided and that the dimensions of the carriage member are such that the latter can be secured both with the hook upwards and with the hook downwards on the guide track. This achieves the advantage that depending on the personal wish of the user the hook can be upwardly open or downwardly open simply by turning the carriage member. The different orientation does not restrict either the function of the carriage member or the possibility of locking the latter in the center position.

The invention will be explained hereinafter in detail with the aid of the embodiments illustrated in the drawings, wherein.

The embodiment of a trapeze belt 1 illustrated in FIGS. 1 to 4 consists substantially of a back portion 2, two shoulder belts 3, 4 and two chest belt portions 5, 6 which are sewn at corresponding points to the back portion 2. To simplify the illustration the associated buckles or other similar fastening members for the belts 3 to 6 are not illustrated.

Figure 4:
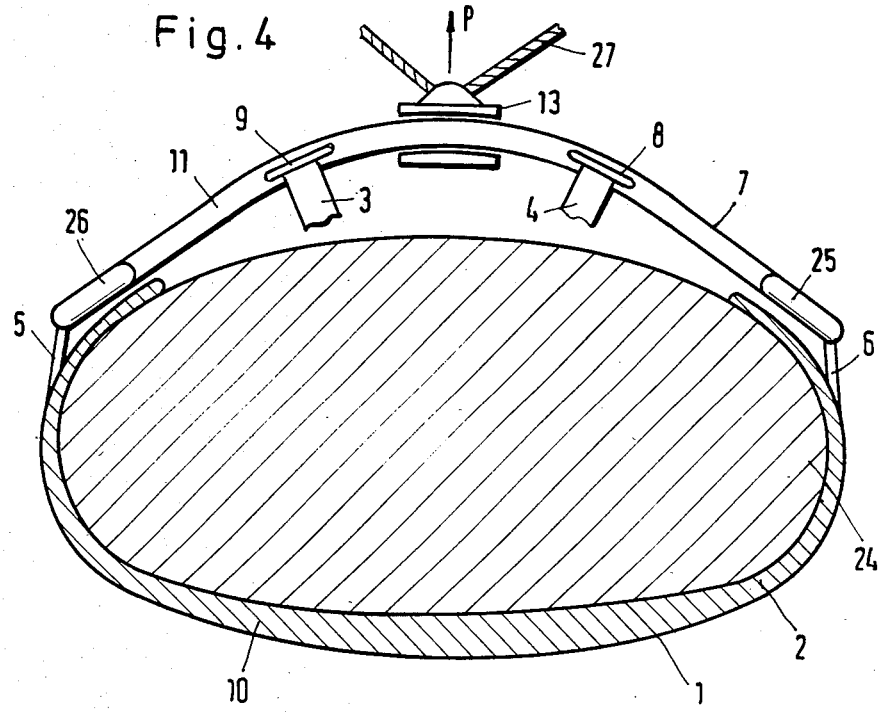
FIG. 4 is a schematic elevation of the trapeze according to the invention with the belt fitted to the user.

As shown, cf FIG. 4, the chest belt portions 5, 6 are secured at both ends of a holding device constructed as spreader bar 7 whilst the shoulder belts 3, 4 are led through eyes 8, 9 at the upper edge of the spreader bar 7.

The back portion 2 is further provided with a cushioning 10 which can at the same time be constructed as float.

Below a detailed explanation will be given with special reference to FIGS. 1 and 2 of the construction of the spreader bar 7 together with the hook construction.

Figure 1:
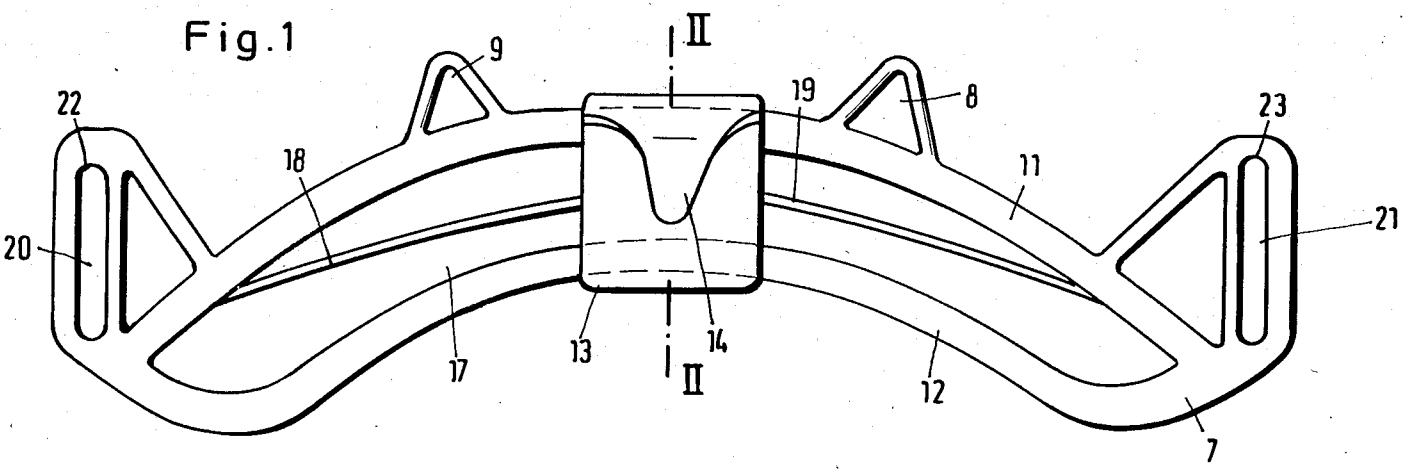
FIG. 1 is a front view of the spreader rail with the carriage displaceable thereon in the trapeze according to the invention in a very schematic representation.

As apparent from the front view of the spreader bar 7 according to FIG. 1 the latter consists in a preferred embodiment of two guide tracks 11, 12 disposed above each other which in the example of embodiment are formed for example from 12 mm thick tubes of Nirosta steel so that the entire construction can be made as welded structure. The guide tracks 11, 12 thus form at the same time the stiff structural element of the spreader bar. Embodiments are of course alternatively possible in which for example the spreader bar consists of plastic and the guide tracks 11,12 are differently formed at the front side of the spreader bar.

As shown the guide tracks 11, 12 are formed parallel to each other arcuately upwardly, the highest point of the arc lying in the middle of the longitudinal extent of the spreader bar 7. Guided in tied manner on the guide tracks 11, 12 jointly is a carriage member 13 which is transversely displaceable and which carries the hook 14. In the example of embodiment the carriage member is made integral as plastic part with the hook 14 so that good sliding properties are obtained on the guide tracks 11, 12.

Figure 2:
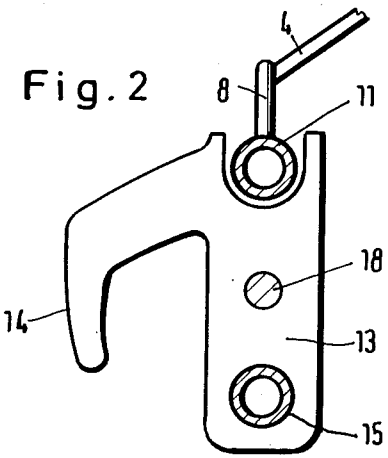
FIG. 2 is a section along the line II—II of FIG. 1.

As apparent from FIG. 2 the carriage member 13 is mounted on the guide tracks 11, 12 in that the lower guide track is led through a bore 15 leading through the carriage member 13 whilst the upper guide track is accommodated in an upwardly open recess 16 extending parallel to the bore 15. This insures that the carriage member 13 can slide unobstructed past the eyes 8, 9 which are welded to the upper guide track 11 and with which the shoulder belts 3, 4 are connected.

As further apparent from FIG. 1 for the carriage member 13 a return means designated generally by 17 is provided which after displacement always returns the carriage member 13 to the set position at the highest part of the arcuate shape. In the example of embodiment the return means 17 is formed as portions of rubber ropes 18, 19 which are connected under tension with one end to the carriage member 13 and with the respective other end secured in the region of the lateral ends of the spreader bar 7.

As further apparent from FIG. 1 for the securing of the chest belt portions 5, 6 in the region of the two opposing ends of the guide tracks 11, 12 perpendicularly extending slit-shaped openings 20, 21 are provided beyond the two opposing ends of the guide tracks 11, 12 and are formed in the example of embodiment likewise by a tubular structure of the same material as the guide tracks 11, 12. The arrangement is such that the slit-shaped openings 20, 21 are upwardly offset with respect to the ends of the guide tracks 11, 12, the upper ends of the slit-shaped openings 20, 21 lying substantially at the level of the uppermost point of the curvature of the upper guide track 11. This insures a stable position of the spreader bar 7 which prevents any tilting movements.

As further apparent from FIG. 4 the guide tracks 11, 12 are also forwardly arcuate, the highest point of the arc likewise corresponding to the center position of the carriage member. In the example of embodiment this forward arching is identical for both guide tracks 11, 12 so that a parallel construction results. However, embodiments are also possible in which to optimize the position of the hook 14 in the various positions of the carriage member 13 different forward curvatures are used.

In FIG. 4, 24 represents in cross-section the chest of a user. As apparent the chest belt portions 5, 6 are attached in the region of the lateral end portions 25, 26 of the spreader bar 7 so that the force p exerted by the trapeze lines 27 is transmitted over a large area to the back portion 2 without constriction of the chest 24. It is obvious that the slide or carriage member 13 can assume any desired position with respect to the guide tracks 11, 12 without impairing these optimum conditions by inclined tension.

Figure 5:
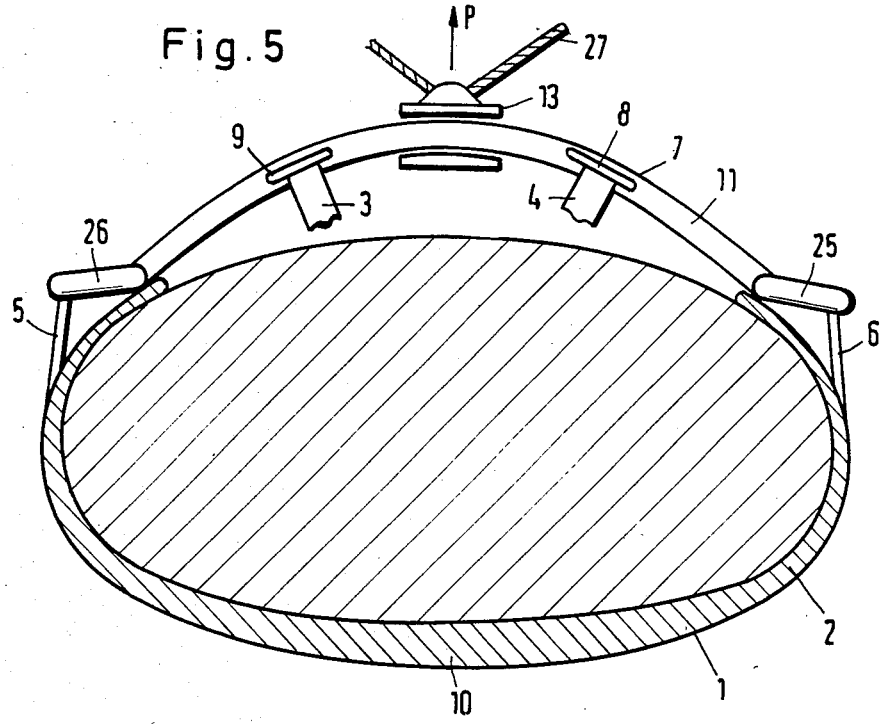
FIG. 5 is a view corresponding to FIG. 4 of a modified embodiment.

The embodiment of FIG. 5 illustrated in the same manner as FIG. 4 differs from the embodiment shown by the latter only in that the end portions 25, 26 are angled forwardly with respect to the guide tracks 11, 12 which can be of advantage for the stability and comfort of the entire trapeze device. Otherwise, the same reference numerals have been used for the same parts.

Figure 3:
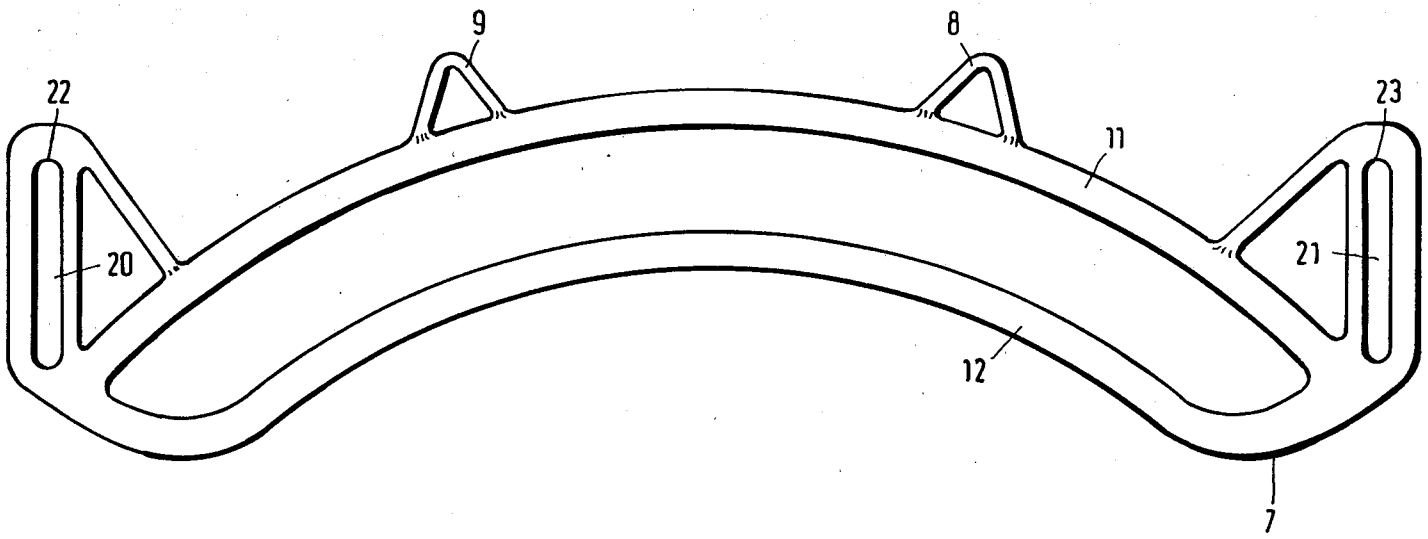
FIG. 3 is a front elevation corresponding to FIG. 1 showing however the spreader bar without the carriage member.
Figure 6:
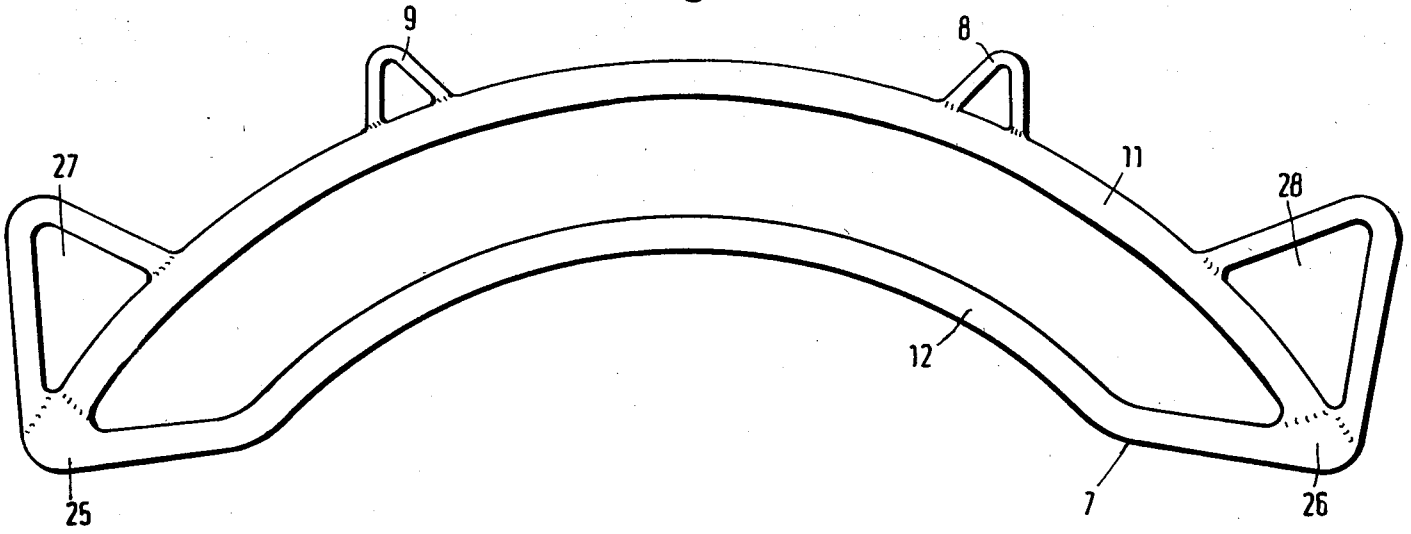
FIG. 6 is a view corresponding to FIG. 3 of a further embodiment.

Likewise, FIG. 6 shows in a manner substantially corresponding to FIG. 3 a further modification which differs however from FIG. 3 only in the different construction of the end portions 25, 26. In this example of embodiment instead of the slit-like openings 20, 21 triangular openings 27, 28 are provided for securing the chest portions 5, 6 which are bent integrally from the lower guide track 12 upwardly and welded to the upper guide track 11.

Figure 7:
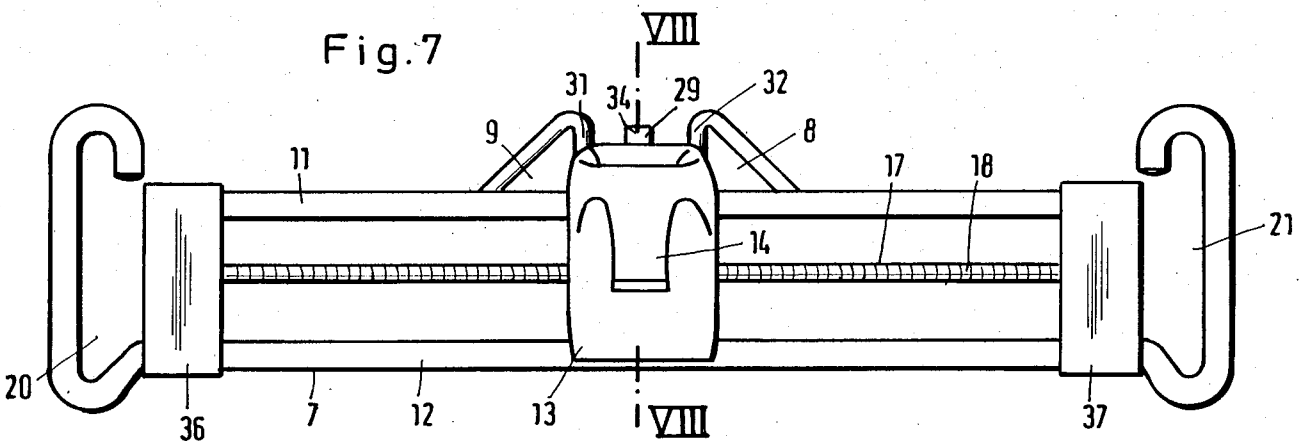
FIG. 7 is a view corresponding to FIG. 1 of a preferred embodiment.
Figure 8:
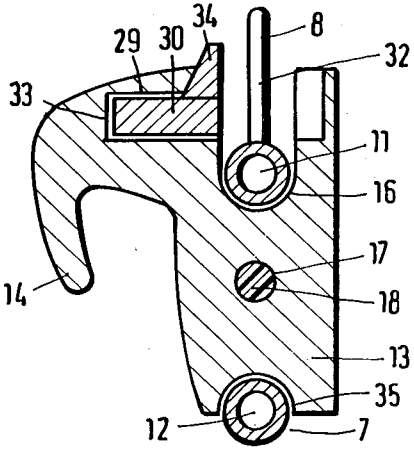
FIG. 8 is a section of the embodiment according to FIG. 7 along the line VIII—VIII in FIG. 7.

In FIGS. 7 and 8, in which for the same or similarly acting members identical reference numerals are used so that reference can be made to the above description, a particularly preferred embodiment of the invention is shown which differs from the previously described embodiments in the essential features that for locking the carriage member 13 in the center position a locking means generally designated by 29 is provided.

In the example of embodiment illustrated the locking means 29 is formed by a slide 30 which engages positively between two stops 31, 32. As shown, in this embodiment the securing eyes 8, 9 are disposed symmetrically to the center line closer together so that the portions of the securing eyes 8, 9 standing substantially perpendicularly with respect to the guide track 11 are spaced a distance apart corresponding substantially to the width of the slide 30.

In the example of embodiment the slide 30 is slidingly displaceable in a recess 33 in the carriage member.

In the condition illustrated schematically in FIG. 8 the slide 30 is in a position in which the carriage member 13 is obstructed in its movement only by the return means 17.

To lock the carriage member 13 in the center position the slide 30 is pushed by means of the upwardly projecting button 34 in the view of FIG. 8 to the right and engages between the stops 31, 32 formed by the securing eyes 8, 9 on the upper guide track 11. This locks the carriage member 13 so that the trapeze can be used like a conventional trapeze in particular for beginners.

The embodiment illustrated in FIGS. 7 and 8 also differs in that instead of the lower through bore 15 in the carriage member a recess 35 downwardly open on one side is provided which extends parallel to the recess 16 and in which the lower guide track 12 slides.

Furthermore, the guide tracks 11, 12 in the example of embodiment are not upwardly curved additionally to the forward arching. The upper guide track 11 is further held two holders 36, 37 which are connected to the lower guide track 12 and which for example can consist of plastic. This makes it possible in simple manner for assembly to insert the two guide tracks 11, 12 into the laterally open recesses 16 and 35 respectively.

Figures 9, 10:
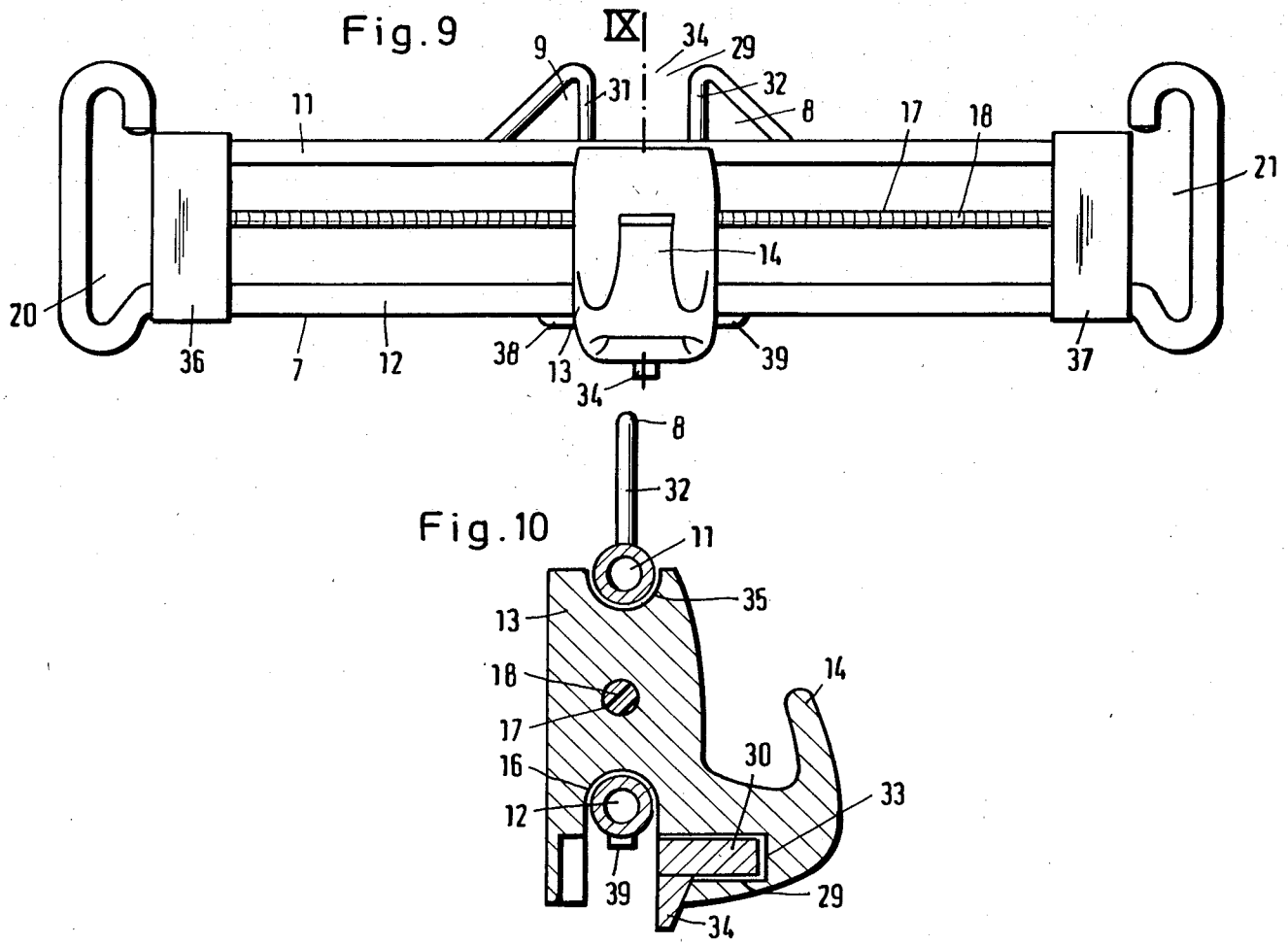
FIG. 9 is a view corresponding to FIG. 7 of a particularly preferred embodiment and FIG. 10 is a section of embodiment according to FIG. 9 along the line IX in FIG. 9.

In FIGS. 7 and 10, in which once again for the same or similarly acting parts identical reference numerals are used so that reference can be made to the above description, a particularly preferred development of the invention is illustrated which shows that the carriage member 13 depending on the desired orientation of the hook 14 can be used in two different positions, the other function of the trapeze belt being retained.

As shown, for this purpose at the lower guide track 12 two stops 38, 39 are also provided which correspond to the stops 31, 32 at the upper guide track 11. These additional stops 38, 39 permit the carriage member 13 to be secured in the center position by means of the locking device 29 when the carriage member is in the position illustrated in FIGS. 9 and 10 in which the hook 14 points upwardly.

It is possible to change the orientation of the hook 14 depending on the personal wish of the user in that the carriage member 13 has two open recesses 16, 35 in which the guide tracks 11, 12 slide. As a result in both orientations of the carriage member the movement is not restricted either by the stops 31, 32 or by the stops 38, 39 unless the locking device 29 is engaged.

It is obvious that such a carriage member 13 having open recesses 16, 35 as guides on both sides can also be used with or without the locking device 29 in the embodiments according to FIGS. 1 to 6.

I claim:

1. A trapeze belt device for windsurfing which comprises:

(a) a belt means worn by the body of a user in the chest region;

(b) a rigid holding and spreading means secured to said belt means for wearing across the lower front chest of the user;

(c) a carriage on said belt means and mounted for movement along said holding and spreading means; and (d) a hook on said carriage adapted for engagement with lines secured to both sides of a wishbone boom of a windsurfer.

2. A trapeze belt device according to claim 1, characterized in that the holding and spreading means includes an upper and a lower guide track (11, 12) for the carriage movement.

3. A trapeze belt device according to claim 2, characterized in that the guide tracks (11, 12) are arcuately curved upwardly, the highest part of the arc corresponding to the center position of the carriage member (13).

4. A trapeze belt device according to claim 2, characterized in that guide tracks (11, 12) are arched arcuately forwardly, the highest point of the arc corresponding to the center position of the carriage member (13).

5. A trapeze belt device according to claim 2, characterized in that the guide tracks (11, 12) are formed by tube sections.

6. A trapeze belt device according to claim 2, characterized in that securing points for the chest belt portions (5, 6) are formed as perpendicularly extending slit-like openings (20, 21) beyond the two opposing ends of the guide tracks (11, 12).

7. A trapeze belt device according to claim 6, characterized in that slit-like openings (20, 21) are upwardly offset with respect to the ends of the guide tracks (11, 12).

8. A trapeze belt device according to claim 7, characterized in that the upper ends (22, 23) of the slit-like openings (20, 21) lie substantially at the level of the uppermost point of the upper guide track (11).

9. A trapeze belt device according to claim 2, characterized in that guide tracks (11, 12) have different forward curvatures.

10. A trapeze belt device according to claim 2, characterized in that carriage member (13) slidingly accommodates the lower guide track (12) in a through bore (15) and the upper guide track (11) is accommodated in a recess (16) open on one side and extending parallel to the bore (15).

11. A trapeze belt device according to claim 10, characterized in that one or more securing eyes (8, 9) for the shoulder belt portions (3, 4) are secured to the upper guide track (11) in such a manner that they lie in the path of movement of the recess (16) of the carriage member (13).

12. A trapeze belt device according to claim 2, characterized in that a return means provides resilient forces to hold the carriage member (13) in a center position.

13. A trapeze belt device according to claim 2, charactrized in that a locking means (29) is provided for locking the carriage member (13) in a center position.

14. A trapeze belt device according to claim 13, characterized in that the locking means (29) is formed by a slide (30) which engages positively between two stops (31, 32).

15. A trapeze belt device according to claim 14, characterized in that stops (31, 32) are formed by portions of the securing eyes (8, 9) standing substantially perpendicularly with respect to the guide track (11), the spacing of the securing eyes (8, 9) corresponding to the width of the slide (30).

16. A trapeze belt device according to claim 14 or 15, characterized in that the slide (30) is slidingly displaceable in a recess (33) of the carriage member (13).

17. A trapeze belt device according to claim 16, characterized in that at the lower guide track (12) two stops (38, 39) corresponding to the stops (31, 32) at the upper guide track (11) are provided and that the dimensions of the carriage member (13) are such that the latter can be secured both with the hook (14) upwards and with the hook downwards on the guide track (11, 12).

* * * * *